US007172098B2

(12) United States Patent
Garcia et al.

(10) Patent No.: US 7,172,098 B2
(45) Date of Patent: Feb. 6, 2007

(54) DISPENSING HEAD MOUNTED ON A MOBILE HOLLOW ACTUATING SHAFT

(75) Inventors: Firmin Garcia, Evreux (FR); Fabrice Perignon, Verneuil sur Avre (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/510,109

(22) PCT Filed: Apr. 1, 2003

(86) PCT No.: PCT/FR03/01009

§ 371 (c)(1),
(2), (4) Date: May 23, 2005

(87) PCT Pub. No.: WO03/084673

PCT Pub. Date: Oct. 16, 2003

(65) Prior Publication Data

US 2005/0211798 A1 Sep. 29, 2005

(30) Foreign Application Priority Data

Apr. 4, 2002 (FR) ..... 02 04585

(51) Int. Cl.
*B65D 83/00* (2006.01)

(52) U.S. Cl. ..... 222/402.13; 222/182; 222/402.15; 222/518; 239/354; 239/569

(58) Field of Classification Search ..... 239/302, 239/333, 349, 360, 375, 369, 569, 337, 340, 239/350, 364; 222/182, 402.13, 402.15, 222/518

See application file for complete search history.

(56) References Cited

U.S. PATENT DOCUMENTS 3,584,789 A 6/1971 Traynor
4,957,239 A * 9/1990 Tempelman ..... 239/117
5,096,098 A * 3/1992 Garcia ..... 222/402.13
5,622,318 A * 4/1997 Bougamont et al. ..... 239/490
5,624,055 A * 4/1997 Clanet et al. ..... 222/135
5,738,282 A * 4/1998 Grogan ..... 239/492

FOREIGN PATENT DOCUMENTS

FR 2 654 079 A 5/1991
FR 2 772 010 A 6/1999
FR 2772010 A1 * 6/1999

* cited by examiner

*Primary Examiner*—Kevin Shaver

*Assistant Examiner*—Jason Boeckmann

(74) *Attorney, Agent, or Firm*—Sughrue Mion, PLLC

(57) ABSTRACT

A dispenser head comprising a connection sleeve (20), a dispenser orifice (31), a duct (123) connecting said connection sleeve (20) to the dispenser orifice, and a press surface (11), the head further comprising a shutter (4) that is housed, at least in part, in said duct (123), and that is resiliently biased by spring means (47) towards said dispenser orifice (31), said shutter (4) including a contact zone (41) that bears in resilient leaktight manner against the dispenser orifice (31) so as to seal it hermetically, said shutter being axially movable against the spring means in such a manner as to withdraw its contact zone from the dispenser orifice, thereby creating an outlet passage for the fluid, the shutter including at least one abutment zone (440) that is resiliently biased by the spring means against a fixed support zone (34).

20 Claims, 3 Drawing Sheets

DISPENSING HEAD MOUNTED ON A MOBILE HOLLOW ACTUATING SHAFT

FIELD OF THE INVENTION

The present invention relates to a dispenser head designed to be mounted on a movable hollow actuator rod which serves as a delivery channel mounted on the outlet of a fluid dispenser member such as a pump or a valve. A conventional design for a pump or a valve provides a hollow actuator rod through which the fluid under pressure is delivered to the dispenser head. Usually, the dispenser head includes a connection sleeve designed to be engaged on the open free end of the movable actuator rod. Under such circumstances, the head also defines a dispenser orifice which is connected to the connection sleeve via an internal duct. In addition, the dispenser head is provided with a press surface on which it is possible to press by means of one or more fingers in order to move the head axially, and consequently drive the hollow actuator rod into the dispenser member.

The present invention relates more particularly to the type of dispenser head incorporating a shutter, i.e. a device enabling the dispenser orifice to be closed. Thus, the fluid stored inside the head is completely isolated from the outside, and thus cannot be spoilt by oxidizing or by drying-out. By definition, the shutter closes the dispenser member where the fluid is dispensed out from the head. However, it is possible for the shutter to be situated a little upstream, i.e. inside the dispenser head, with the device still constituting a shutter.

BACKGROUND OF THE INVENTION

In conventional manner, that type of shutter is situated, at least in part, inside the duct connecting the dispenser member to the connection sleeve. In addition, the shutter is often resiliently biased by spring means towards the dispenser orifice. Under such circumstances, it should be understood that the shutter is an internal shutter situated inside the dispenser head, and that the dispenser orifice is opened by retracting the shutter further into the dispenser head.

Document FR-2 654 079 describes a dispenser head incorporating such a shutter. In that document, the shutter is housed inside the dispenser head below the press surface on which it is possible to press in order to actuate the dispenser member. At one of its ends, the shutter includes a plunger pin designed to come selectively into leaktight contact with the dispenser orifice. At its opposite end, the shutter defines spring means in the form of an elastically deformable strip which bears against the body of the dispenser head. Furthermore, shutter displacement means are provided in the form of a cam secured to the bearing surface. Under such circumstances, the bearing surface is elastically deformable so that it is possible to press down the cam through the shutter, which thus forms an actuator window. By lowering the cam in this way, by pressing down on the press surface, the shutter is moved towards the inside of the dispenser head by deforming its resilient strip. This movement withdraws the plunger pin from the dispenser orifice, and thus releases an outlet passage for the fluid under pressure.

In the dispenser head in that French document, the shutter is moved to release the dispenser orifice by means of a cam, as described above. However, other means for moving the shutter can be envisaged. For example, the shutter can form a piston slidably housed inside a chamber. Thus, when the fluid under pressure arrives in the chamber, the piston is pushed back to slide against spring means, thereby withdrawing the plunger pin from the dispenser orifice. Consequently, it can be seen that various means for moving the shutter are possible. In any event, the present invention relates more particularly to shutters having a plunger pin that is resiliently biased by spring means.

In dispenser heads having shutters that are resiliently biased, it is very difficult to control the force with which the spring means press the plunger pin into the dispenser orifice. Naturally, the force is proportional to the intrinsic stiffness of the spring means, but it is also proportional to their position inside the dispenser head. Furthermore, friction forces have an influence on the pressure force. A major drawback with that type of shutter resides in the fact that, sometimes, the plunger pin is pressed too far into the dispenser orifice so that it remains jammed therein. It is then no longer possible to use the dispenser head, and consequently the dispenser member (the pump or the valve). Furthermore, even when the plunger pin does not remain literally jammed in the dispenser orifice, the shutter may remain temporarily jammed, and that it bursts free suddenly when the press surface of the dispenser head is pressed down hard. Thus, as a result, and contrary to the desired effect, the fluid is dispensed in a violent or explosive manner. Naturally, all of these drawbacks are associated with the lack of mastery or of control over the thrust force exerted by the spring means on the dispenser orifice.

SUMMARY OF THE INVENTION

Consequently, an object of the present invention is to remedy, or at least to mitigate, the above-mentioned drawbacks of the prior art by defining a dispenser head in which the resiliently-biased shutter bears in controlled and constant manner on the dispenser orifice so that it is actuated in effective and constant manner.

In order to achieve the objects, the present invention proposes a dispenser head designed to be mounted on a movable hollow actuator and delivery rod of a fluid dispenser member, said head comprising a connection sleeve designed to be engaged on said movable rod, the head defining a dispenser orifice, a duct connecting said connection sleeve to the dispenser orifice, and a press surface which can be pressed in order to move the head axially by pushing the hollow rod into the dispenser member, the head further comprising a shutter that is housed, at least in part, in said duct, and that is resiliently biased by spring means towards said dispenser orifice, said shutter including a contact zone that bears in resilient leaktight manner against the dispenser orifice so as to seal it hermetically, said shutter being axially movable against the spring means in such a manner as to withdraw its contact zone from the dispenser orifice, thereby creating an outlet passage for the fluid when sufficient pressure is exerted on the press surface, the dispenser head being characterized in that the shutter includes at least one abutment zone that is resiliently biased by the spring means against a fixed support zone, the abutment zone thus taking up a portion of the thrust force generated by the spring means so that the contact zone bears with a constant limited force against the dispenser orifice. Thus, a constant and limited thrust force is guaranteed for the shutter at the dispenser orifice since the excess thrust force is taken up by the abutment zone. The abutment zone advantageously includes plane abutment surfaces that are situated in symmetrical manner about the travel axis of the shutter, the abutment surfaces coming to bear on associated plane support surfaces.

In a practical embodiment, the shutter comprises a plunger pin connected to a shoulder, the plunger pin thus defining a free end forming the contact zone designed to close the dispenser orifice selectively, the shoulder defining the support zone. The plunger pin advantageously extends into an outlet section of the duct that includes an inlet end defining the support zone and an outlet end defining the dispenser orifice.

In another aspect of the invention, the outlet section is formed with guide splines that project inwards so as to hold the plunger pin on the travel axis of the shutter. Not only is it impossible for the plunger pin to be jammed inside the head, but the plunger pin is also accurately centered on the dispenser orifice.

Still in a practical aspect, the dispenser head comprises a body, and a dispenser endpiece connected in sealed manner on the body, the endpiece forming the duct and the dispenser orifice.

According to another characteristic of the invention, the dispenser head further comprises a displacement cam designed to come into engagement with the shutter so as to move it when sufficient pressure is exerted on the press surface, said cam being designed to come into engagement with an amplification cam so as to amplify the movement of the shutter. Advantageously, the connection sleeve is made integrally as a single piece with the displacement cam, the amplification cam being secured to the press surface.

In another aspect of the invention, the spring means are made integrally as a single piece with the shutter in the form of an elastically deformable loop. At least one of the dispenser orifice and the contact zone advantageously presents a frustoconical configuration. Contact is preferably made cone on cone, with cones that are not necessarily identical so that there is no extended frustoconical contact, but merely annular contact at the position where the two truncated cones touch. In addition, it is advantageous for the contact at the abutment zone to be of the plane on plane type, or at least on a plane that is perpendicular to the travel axis of the shutter.

BRIEF DESCRIPTION OF THE DRAWINGS

The invention is described more fully below with reference to the accompanying drawings which show an embodiment of the invention by way of non-limiting example.

In the figures.

DETAILED DESCRIPTION OF THE INVENTION

Figure 1:
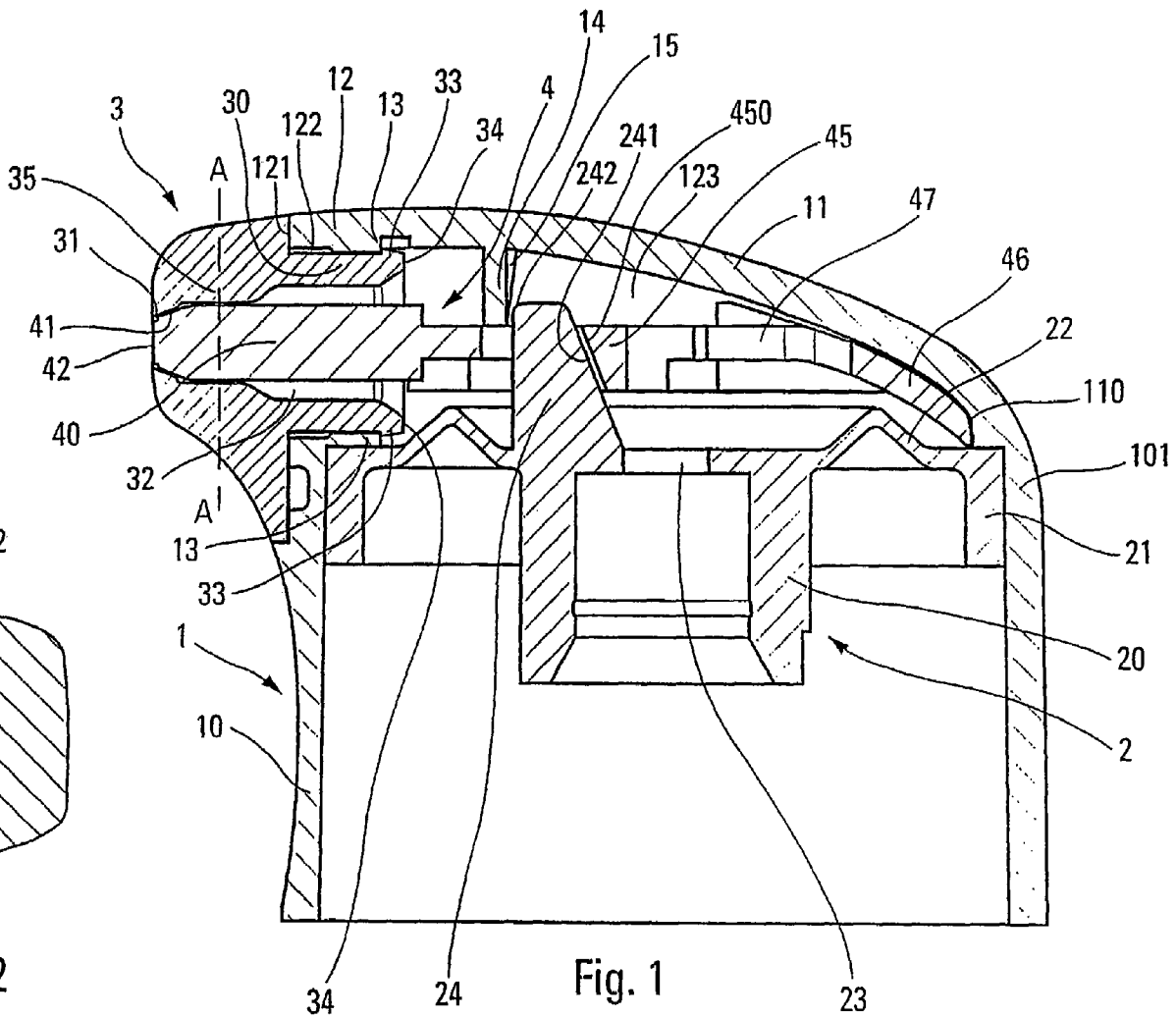
FIG. 1 is a vertical section view through a dispenser head of the invention.

The dispenser head shown in the figures comprises four component elements, namely a body 1, a connection piece 2, a dispenser endpiece 3, and a shutter 4. In this embodiment, the four component elements are distinct and separate from one another, but it is very easy to envisage variant embodiments in which some of the component elements are made integrally as a single piece. For example, it is possible to envisage that the dispenser endpiece and the body are made integrally as a single piece. It is also possible to envisage that the connection piece and the body are made integrally as a single piece. In contrast, it is also possible to envisage that some component elements can be made up of two or more pieces that are initially separate, and that are fitted or fastened together during assembly. All the component elements, namely the parts 1 to 4, can be made of molded plastics material. However, other materials, and other manufacturing techniques, are not excluded.

The body 1 includes a skirt 10 which is generally cylindrical in shape. The body 1 is open at its bottom end, and closed at its top end by a wall defining a press. surface 11 which can be pressed by means of one or more fingers. Furthermore, the skirt 10 defines a lateral opening serving as a housing 12 for receiving the dispenser endpiece 3, as described below. The housing 12 comprises a front bearing surface 121, and an inside wall 122 defining a snap-fastening rim 13. In addition, the press surface 11 is provided with a transverse web 14 which extends downwards from its bottom face. The transverse web 14 forms an inclined surface serving as an amplification cam 15, as described below. The amplification cam 15 slopes away from the housing 12. Where it connects with the skirt 10, the press surface 11 also forms an abutment housing 110 whose function is described below. In addition, the skirt 10 forms a snap-fastening housing 101 designed to receive the connection piece 2.

The connection piece 2 includes a snap-fastening ring 21 that is snapped into the housing 101 formed by the skirt 10 of the body 1. The connection piece 2 also includes a connection sleeve 20 which is disposed inside the ring 21. The connection sleeve 20 is designed to be force-fitted onto the top end of a hollow actuator rod defining an internal fluid delivery channel. The actuator rod forms an integral part of a fluid dispenser member (not shown) such as a pump or a valve. The end wall of the connection sleeve 20 is pierced by a passage 23 which enables fluid to flow into the top portion of the body, just below the press surface 11. In addition, the connection piece 2 forms a displacement cam 24 presenting a cam surface 241 and an amplification edge 242. The connection sleeve 20 and the displacement cam 24 occupy a substantially central position inside the snap-fastening ring 21. The assembly formed by the sleeve 20 and by the cam 24 is substantially rigid, and is connected to the ring 21 by an elastically deformable connection 22. The elastically deformable connection 22 can be made by junction tabs or even by a continuous deformable plate which extends all around the sleeve 20 inside the ring 21. Thus, the sleeve 20 and the cam 24 can be moved inside the ring 21, and consequently inside the body 1. The movement of the sleeve and of the cam can take place axially, i.e. vertically, and also laterally, i.e. radially. In other words, the cam 24 can be moved vertically towards and away from the press surface 11, and also from front to back. Consequently, when sufficient pressure is applied on the press surface 11, the actuator rod engaged in the sleeve 20 moves the sleeve 20 and the cam 24 upwards towards the press surface 11. The vertical movement is accurately axial until the amplification edge 242 comes into sliding or rubbing contact against the amplification cam 15 formed by the transverse web 14. From this moment on, the displacement cam 24 is moved laterally towards the righthand side in FIG. 1, while it is being moved vertically upwards. The amplification cam 15 therefore increases the movement of the cam surface 241 of the displacement cam 24. The advantage of amplifying the movement of the cam 24 in relation to the shutter 4 is described below.

Figure 2:
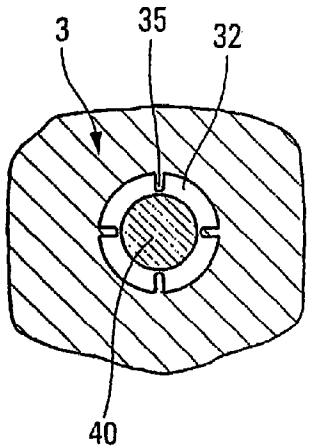
FIG. 2 is a vertical section view through the FIG. 1 dispenser head at its dispenser orifice.

The dispenser endpiece 3 is fastened in completely leaktight manner in the housing 12 of the body 1 by snap-fastening. The dispenser endpiece 3 is forced to bear against the front surface 121, and includes a sealed snap-fastening sleeve 30 that is snapped into the cylinder 122. The sealed snap-fastening sleeve 30 includes a snap-fastening profile 33 which projects radially outwards so as to come into engagement behind the snap-fastening edge 13 formed inside the housing 12. In this way, the dispenser endpiece 3 is held securely in the body 1, and both the rim 13 and the front surface 121 are in leaktight contact with the body. The dispenser endpiece 3 defines an internal duct section 32 which extends from an inside end, defined by the annular end 34 of the snap-fastening sleeve 30, to an outside, other end which forms a dispenser orifice 31. The internal duct section 32 also forms splines 35, which can be seen more clearly in FIG. 2. The splines 35 serve as guide means for the shutter 3, as described below. In addition, the end 34 of the sleeve 30 serves as a support zone or surface for the shutter 4, as described below.

The body 1, the connection piece 2, and the dispenser endpiece 3 form an internal chamber or duct 123 including an inlet 23 and an outlet 31. The section 32 forms a portion of the duct 123. The displacement cam 24 and the amplification cam 15 are situated inside the duct 123.

In this case, the shutter 4 is situated completely inside the duct 123. The shutter forms a plunger pin 40 that is situated completely or in part in the duct section 32, and a shoulder 44 is connected directly to the plunger pin 40. The shutter also forms a drive portion 45 provided with a cam window 450, and spring means 46, 47. The shutter can advantageously be made as a single piece.

Figure 3:
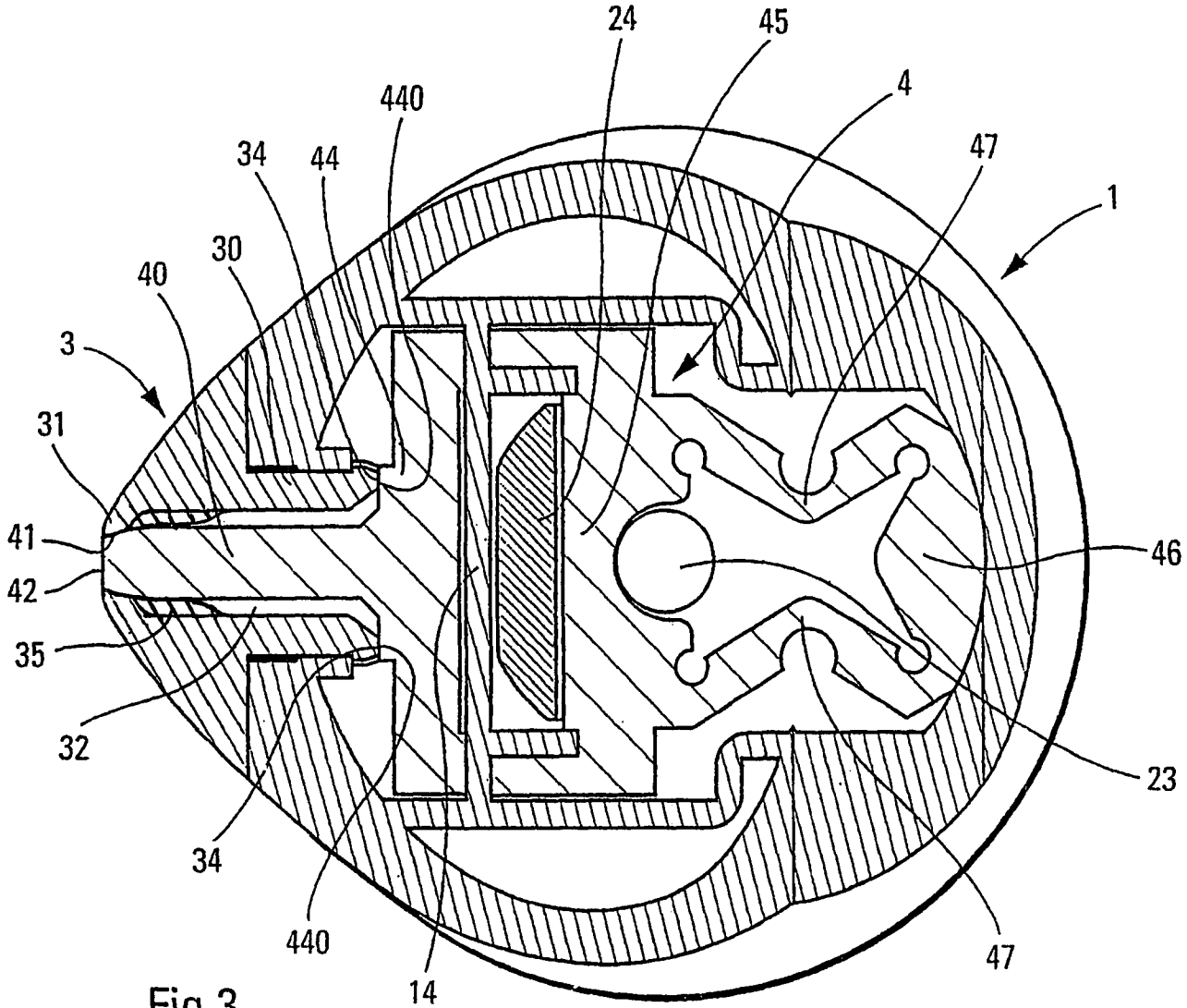
FIG. 3 is a horizontal section view from above of the FIG. 1 dispenser head.

The purpose of the plunger pin 40 is to close the dispenser orifice 31 formed by the endpiece 3 selectively. The plunger pin 40 includes a free end forming a front wall 42, and a contact zone 41 designed to come into leaktight contact against the dispenser orifice 31, so as to seal it hermetically. The plunger pin 40 presents a substantially constant cylindrical section having a diameter that is slightly less than the diameter inside the edges of the splines 35 so that the plunger pin 40 is guided axially inside the duct section 32 with very limited clearance. This thus ensures that the plunger pin 40 is accurately centered in the duct section 32, and thus on the dispenser orifice 31. At its end remote from the front wall 42, the plunger pin 40 is connected to the shoulder 44 which defines two abutment surfaces 440 designed to come into bearing contact against the support zone 34 defined by the dispenser endpiece 3. Beyond the shoulder 44, the displacement cam 24 engaged in the cam window 450 passes through the shutter. The cam surface 241 is oriented so that upwards movement of the cam 24 causes the shutter 4 to be moved from the lefihand side to the righthand side in FIG. 1, i.e. causes the plunger pin 40 to be driven further into the dispenser endpiece 3, thereby breaking the leaktight contact with the dispenser orifice 31, and thus creating an outlet passage for the fluid under pressure. Furthermore, the inward movement of the plunger pin is increased by the amplification cam 15, which displaces the cam 24 away from the dispenser orifice 31. Thus, with limited vertical movement of the cam 24, significant movement of the plunger pin 40 is obtained inside the endpiece 3. Beyond the cam window 450, the shutter 4 forms spring means, in this case in the form of a type of loop or toggle forming a base 46 bearing inside the housing 110, and two hinged legs 47 which provide the resilient characteristic. In the rest state shown in FIGS. 1 and 3, the resilient legs 47 are prestressed so that the plunger pin 40 bears, at its contact zone 41, against the dispenser orifice 31 while taking up the reaction force at its base 46. However, given that the shoulder 44 also comes into abutment against the support 34 at an abutment zone remotely located from the contact zone, not all of the pressure force exerted by the spring means is exerted at the plunger pin 40. The support 34 thus takes up a portion of the pressure force exerted by the spring means, thereby limiting and stabilizing the thrust force at the dispenser orifice 31. Given that both the dispenser orifice 31 and the contact zone 41 present a slightly frustoconical configuration in order to improve sealing, there is the risk of the plunger pin 40 becoming jammed in the dispenser orifice in the event of the pressure force not being taken up by the support 34. Both the abutment zone or surface 440 and the support zone or surface 34 are substantially plane and perpendicular to the displacement direction of the shutter 4, thereby avoiding any risk ofjamming or of gripping. The support 34 offers a clear bearing reference which makes it possible to modulate and stabilize the thrust force of the plunger pin 40 against the dispenser orifice 31.

Figure 4:
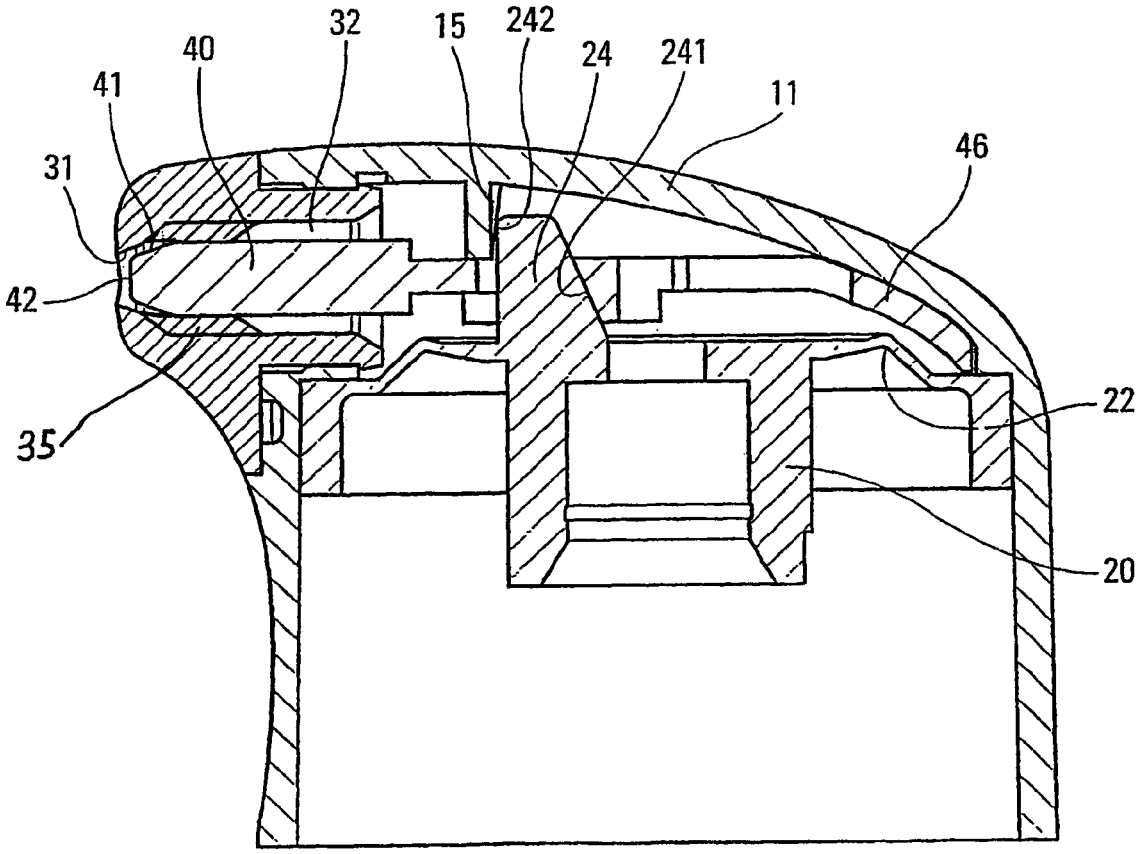
FIG. 4 is a view similar to that of FIG. 1 while dispensing a fluid.

The dispenser head operates as follows. Starting from the rest position shown in FIG. 1, it can be seen that the plunger pin 40 is engaged in sealed manner in the dispenser orifice 31. By pressing on the press surface 11, the actuator rod engaged in the connection sleeve 20 moves the cam 24 upwards towards the press surface 11. In association with the amplification cam 15, the displacement cam 24 thus fulfils its displacement function, and thus moves the plunger pin 40 towards the inside of the head, as can be seen in FIG. 4. The dispenser orifice 31 is thus cleared and an outlet passage is thus created for the fluid under pressure which is delivered by the actuator rod through the duct 123 as far as the dispenser orifice 31. Releasing the pressure on the press surface 11 enables the cam 24 and the sleeve 20 to return to their initial rest positions, as shown in FIG. 1. The plunger pin thus returns to its rest position in leaktight contact with the dispenser orifice 31. The plunger pin is returned to said position by the spring means 47.

In the embodiment used to illustrate the present invention, the shutter is moved by means of a cam system. Other means of moving the shutter can easily be envisaged, such as the pressure of the fluid inside the duct 123, for example. The shutter can thus be formed with a piston sliding in sealed manner inside a slide cylinder. One of the advantageous characteristics of the invention resides in the fact that not all of the pressure force exerted by the spring means is exerted at the dispenser orifice.

The invention claimed is:

1. A dispenser head designed to be mounted on a movable hollow actuator and delivery rod of a fluid dispenser member, said head comprising a connection sleeve (20) designed to be engaged on said movable rod, the head defining a dispenser orifice (31), a duct (123) connecting said connection sleeve (20) to the dispenser orifice, and a press surface (11) which can be pressed in order to move the head axially by pushing the hollow rod into the dispenser member, the head further comprising a shutter (4) that is housed, at least in part, in said duct (123), and that is resiliently biased by spring means (47) towards said dispenser orifice (31), said shutter (4) including a contact zone (41) that bears in resilient leaktight manner against the dispenser orifice (31) so as to seal the dispenser orifice hermetically, said shutter being axially movable against the spring means in such a manner as to withdraw the contact zone from the dispenser orifice, thereby creating an outlet passage for the fluid when sufficient pressure is exerted on the press surface, the shutter including at least one abutment zone (440) that is resiliently biased by the spring means against a fixed support zone (34), the abutraent zone thus taking up a portion of the thrust force generated by the spring means so that the contact zone bears with a constant limited force against the dispenser orifice, the dispenser head being characterized in that at least one of the dispenser orifice (31) and the contact zone (41) presents a frustoconical configuration; and wherein the shutter comprises an elongated plunger pin that extends within an elongated outlet section of the duct, the outlet section having an interior surface extending between the contact zone and the abutment zone, the interior surface opposing a facing exterior surface of the pin and spaced apart from the exterior surface of the pin.

2. A dispenser head according to claim 1, in which the abutment zone includes plane abutment surfaces (440) that are situated in symmetrical manner about the travel axis of the shutter, the abutment surfaces (440) coming to bear on associated plane support surfaces (34).

3. A dispenser head according to claim 1, in which the plunger pin (40) extends into an outlet section (32) of the duct that includes an inlet end defining the support zone (34) and an outlet end defining the dispenser orifice (31).

4. A dispenser head according to claim 3, in which the outlet section (32) is formed with guide splines (35) that project radially inwards so as to hold the plunger pin (40) on the travel axis of the shutter.

5. A dispenser head according to claim 1, comprising a body (1), and a dispenser endpiece (3) connected in sealed manner on the body, the endpiece (3) forming the duct (32) and the dispenser orifice (31).

6. A dispenser head according to claim 1, further comprising a displacement cam (24) designed to come into engagement with the shutter so as to move the shutter when sufficient pressure is exerted on the press surface, said cam being designed to come into engagement with an amplification cam (15) so as to amplify the movement of the shutter.

7. A dispenser head according to claim 6, in which the connection sleeve (20) is made integrally as a single piece with the displacement cam (24), the amplification cam being secured to the press surface (11).

8. A dispenser head according to claim 1, in which the spring means (47) are made integrally as a single piece with the shutter (4) in the form of an elastically deformable loop (46, 47).

9. A dispenser head according to claim 1, wherein the plunger pin is connected to a shoulder, the plunger pin defining a free end forming the contact zone configured to close the dispenser orifice selectively, the shoulder defining the abutment zone.

10. The dispenser head according to claim 9, wherein the plunger pin extends into the outlet section of the duct that comprises an inlet end definng the support zone and an outlet end defining the dispenser orifice.

11. The dispenser head according to claim 10, wherein the outlet section is formed with guide splines that project radially inwards so as to hold the plunger pin on the travel axis of the shutter.

12. A dispenser head configured to be mounted on a movable hollow actuator and delivery rod of a fluid dispenser member, the head comprising:

a connection sleeve configured to engage the movable rod;

a dispenser orifice;

a duct connecting the connection sleeve to the dispenser orifice;

a press surface that when pressed moves the head axially so as to push the hollow rod into the dispenser member; and a shutter housed, at least in part, in the duct and that is resiliently biased by a spring towards the dispenser orifice, said shutter comprising a contact zone that bears in resilient leaktight manner against the dispenser orifice so as to hermetically seal the orifice, the shutter axially movable against the spring so as to withdraw the contact zone from the dispenser orifice, thereby creating an outlet passage for the fluid when sufficient pressure is exerted on the press surface, the shutter comprising at least one abutment zone that is resiliently biased by the spring against a fixed support zone, the abutment zone taking up a portion of the thrust force generated by the spring so that the contact zone bears with a constant limited force against the dispenser orifice;

wherein at least one of the dispenser orifice and the contact zone is frustoconical and the abutment zone is remotely located from the contact zone; and wherein the shutter comprises an elongated plunger pin that extends within an elongated outlet section of the duct, the outlet section having an interior surface extending between the contact zone and the abutment zone, the interior surface opposing a facing exterior surface of the pin and spaced apart from the exterior surface of the pin.

13. The dispenser head according to claim 12, wherein the abutment zone comprises plane abutment surfaces situated in symmetrical manner about a travel axis of the shutter, the abutment surfaces coming to bear on associated plane support surfaces.

14. The dispenser head according to claim 12, further comprising a body and a dispenser endpiece connected in sealed manner on the body, the endpiece forming the duct and the dispenser orifice.

15. The dispenser head according to claim 12, further comprising a displacement cam configured to come into engagement with the shutter so as to move the shutter when sufficient pressure is exerted on the press surface, said cam being designed to come into engagement with an amplification cam so as to amplify the movement of the shutter.

16. The dispenser head according to claim 15, wherein the connection sleeve is made integrally as a single piece with the displacement cam, the amplification cam being secured to the press surface.

17. The dispenser head according to claim 12, wherein the spring is made integrally as a single piece with the shutter in the form of an elastically deformable loop.

18. The dispenser head according to claim 12, wherein the plunger pin has a diameter within the elongated outlet section that is less than a diameter of the opposing interior surface of the outlet section so as be spaced apart therefrom and leave a gap.

19. A dispenser head designed to be mounted on a movable hollow actuator and delivery rod of a fluid dispenser member, said head comprising a connection sleeve (20) designed to be engaged on said movable rod, the head defining a dispenser orifice (31), a duct (123) connecting said connection sleeve (20) to the dispenser orifice, and a press surface (11) which can be pressed in order to move the head axially by pushing the hollow rod into the dispenser member, the head further comprising a shutter (4) that is housed, at least in part, in said duct (123), and that is resiliently biased by spring means (47) towards said dispenser orifice (31), said shutter (4) including a contact zone (41) that bears in resilient leak tight manner against the dispenser orifice (31) so as to seal the dispenser orifice hermetically, said shutter being axially movable against the spring means in such a manner as to withdraw the contact zone from the dispenser orifice, thereby creating an outlet passage for the fluid when sufficient pressure is exerted on the press surface, the shutter including at least one abutment zone (440) that is resiliently biased by the spring means against a fixed support zone (34), the abutment zone thus taking up a portion of the thrust force generated by the spring means so that the contact zone bears with a constant limited force against the dispenser orifice, the dispenser head being characterized in that at least one of the dispenser orifice (31) and the contact zone (41) presents a frustoconical configuration; and wherein the dispenser head further comprises a displacement cam designed to come into engagement with the shutter so as to move the shutter when sufficient pressure is exerted on the press surface, said cam being designed to come into engagement with an amplification cam so as to amplify the movement of the shutter.

20. The dispenser head according to claim 19, wherein the shutter comprises an elongated plunger pin connected to a shoulder, the plunger pin thus defining a free end forming the contact zone designed to close the dispenser orifice selectively, the shoulder defining the abutment zone.

* * * * *